US008967761B2

(12) United States Patent
Sato et al.

(10) Patent No.: US 8,967,761 B2
(45) Date of Patent: Mar. 3, 2015

(54) LIQUID EJECTING APPARATUS

(71) Applicant: Seiko Epson Corporation, Tokyo (JP)

(72) Inventors: Hironori Sato, Matsumoto (JP); Masako Fukuda, Shiojiri (JP); Tomohiro Sayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/304,724

(22) Filed: Jun. 13, 2014

(65) Prior Publication Data

US 2014/0375720 A1 Dec. 25, 2014

(30) Foreign Application Priority Data

Jun. 19, 2013 (JP) ..... 2013-128245

(51) Int. Cl.
*B41J 29/393* (2006.01)
*B41J 11/00* (2006.01)

(52) U.S. Cl.
CPC ..... *B41J 11/002* (2013.01)
USPC ..... 347/19; 347/102

(58) Field of Classification Search
None
See application file for complete search history.

(56) References Cited

U.S. PATENT DOCUMENTS 7,021,753 B2 * 4/2006 Sano et al. ..... 347/102
7,445,315 B2 * 11/2008 Young et al. ..... 347/56
8,746,865 B2 * 6/2014 Tojo et al. ..... 347/96

FOREIGN PATENT DOCUMENTS

JP 2010-221670 A 10/2010

* cited by examiner

*Primary Examiner* — Lamson Nguyen
(74) *Attorney, Agent, or Firm* — Kilpatrick Townsend & Stockton LLP

(57) ABSTRACT

A liquid ejecting apparatus has a liquid ejecting head capable of ejecting an ink containing thermoplastic resin particles from nozzles to a landing target and a heating unit of heating ink droplets landing on the landing target, in which the heating unit heats the ink droplets at a filming control temperature according to the minimum film forming temperature at which the filming of the surface of the ink droplets starts to thereby control the filming degree of the surface of the ink droplets.

9 Claims, 4 Drawing Sheets

LIQUID EJECTING APPARATUS

This application claims priority to Japanese Application No. 2013-128245, filed on Jun. 19, 2013, the entirety of which is incorporated by reference herein.

BACKGROUND

1. Technical Field

The present invention relates to a liquid ejecting apparatus having a liquid ejecting head which ejects an ink containing thermoplastic resin particles from nozzles.

2. Related Art

The liquid ejecting apparatus has a liquid ejecting head and ejects various kinds of liquid from this ejecting head. As the liquid ejecting apparatus, image recorders, such as an ink jet printer and an ink jet plotter which eject ink, are known, for example. In recent years, these image recorders have been demanded to record images and the like not only on ink-absorbing recording media (landing target) which are easy to absorb ink, such as paper and cloth, but on non-ink-absorbing recording media which do not absorb ink, such as a plastic film.

In order to fix ink on the non-ink-absorbing recording media described above, one which ejects an ink containing thermoplastic resin particles, and then drying the ink landing on the recording media by a heating unit, such as a heater, to film (formed into a film) has been proposed (for example, Japanese Patent Laid-Open No. 2010-221670). Thus, the filmed ink can be fixed on the non-ink-absorbing recording media.

When the ink containing thermoplastic resin particles described above is made to land on the non-ink-absorbing recording media, and then filmed, an apparent gloss feeling changes depending on the degree of irregularities of the ink film (resin film) formed in the shape of a dot. For example, when the irregularities of the ink film are small, glossy appearance is achieved, so that a high-class feeling can be imparted to a formed image. On the other hand, when the irregularities of the ink film are large, a mat appearance without gloss is achieved, and it becomes possible to suppress reflection of the surrounding light. It has not been easy to control such a gloss degree according to the intended use.

SUMMARY

An advantage of some aspects of the invention is to provide a liquid ejecting apparatus capable of controlling a gloss feeling of an image to be formed in a liquid ejecting apparatus having a liquid ejecting head which ejects an ink containing thermoplastic resin particles.

The invention has been proposed in order to achieve the above-described object and has a liquid ejecting head capable of ejecting an ink containing thermoplastic resin particles from nozzles to a landing target and a heating unit of heating ink droplets landing on the landing target, in which the heating unit heats the ink droplets at a filming control temperature according to the minimum film forming temperature at which the filming of the surface of the ink droplets starts to thereby control the filming degree of the surface of the ink droplets.

According to this configuration, the filming degree of the surface of the ink droplets can be controlled, and therefore the degree of the irregularities formed by the ink droplets can be controlled. Thus, the gloss feeling of an image to be formed can be controlled. For example, it becomes possible to impart a gloss feeling to impart a high-class feeling to the image to be formed or impart a mat feeling thereto to suppress reflection of the surrounding light.

In the above-described configuration, it is desirable for the heating unit to perform heating at a temporary curing temperature of increasing the viscosity without filming the ink droplets, and then perform heating at the filming control temperature.

According to this configuration, the ink droplets landing on the landing target can be suppressed from shifting from the landing position. As a result, a high definition image with less density unevenness can be formed.

Moreover, in the above-described configuration, it is desirable for the heating unit to perform heating at the filming control temperature, and then perform heating at a main curing temperature at which all the ink droplets are filmed.

According to this configuration, the ink droplets can be certainly fixed onto the landing target.

Furthermore, in each of the above-described configurations, the filming control temperature is desirably equal to or lower than the minimum film forming temperature.

According to this configuration, the irregularities formed by the ink droplets can be made small. Thus, the glossiness of the image to be formed can be increased, and a gloss feeling can be further imparted.

Moreover, in the above-described configuration, it is desirable to apply the filming control temperature for 40 seconds or more and 80 seconds or less.

Furthermore, the filming control temperature can also be set to a temperature higher than the minimum film forming temperature and equal to or less than the main curing temperature at which all the ink droplets are filmed.

According to this configuration, the irregularities formed by the ink droplets can be made large. Thus, the glossiness of the image formed can be decreased, so that a mat feeling can be imparted.

Moreover, in the above-described configuration, it is desirable to apply the filming control temperature for 40 seconds or more and 80 seconds or less.

Furthermore, in each of the configurations described above, it is desirable for the heating unit to have a temporary curing heater of heating the landing target at the temporary curing temperature, a leveling heater of heating the landing target, which is heated by the temporary curing heater, at the filming control temperature, and a main curing heater of heating the landing target, which is heated by the leveling heater, at the main curing temperature.

According to this configuration, the filming degree of the surface of the ink droplets can be controlled only by transporting the landing target from the temporary curing heater to the main curing heater through the leveling heater.

It is desirable for the heating unit to have a temporary curing heater of heating the landing target at the temporary curing temperature, an air sending unit capable of sending the heat of the temporary curing heater to the landing target side to heat the landing target to the filming control temperature, and a main curing heater of heating the landing target, which is heated to the filming control temperature by the air sending unit, at the main curing temperature.

According to this configuration, the number of heaters can be reduced, so that the configuration is simplified.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
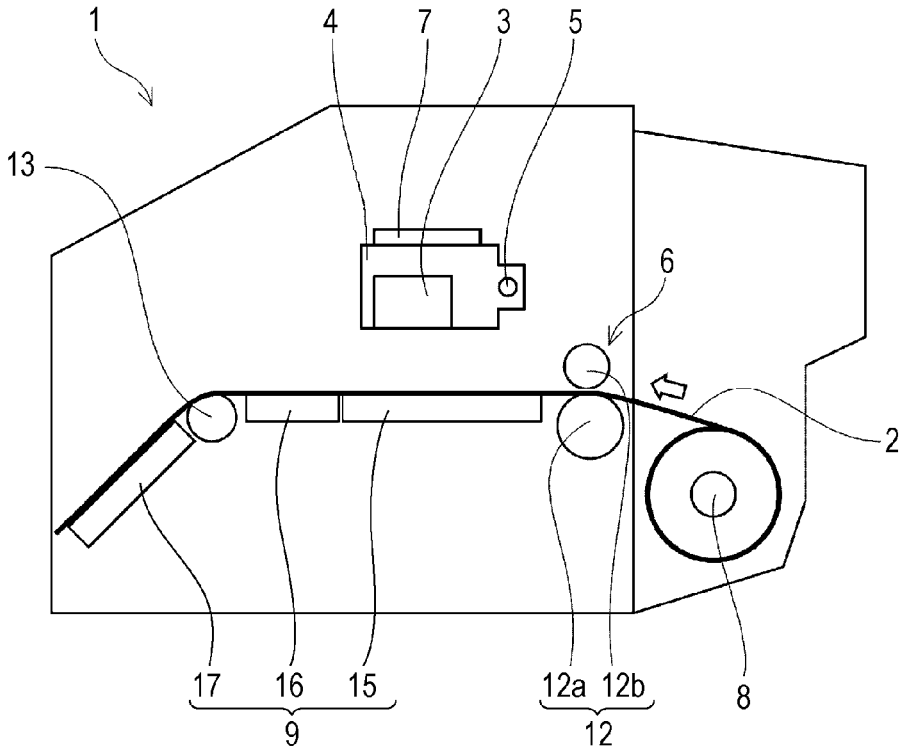
FIG. 1A is a schematic view for explaining the configuration of a printer and is a cross sectional view.

Hereinafter, aspects for carrying out the invention are described with reference to the accompanying drawings. Embodiments described below are variously limited as a suitable example of the invention but the scope of the invention is not limited to the aspects insofar as there is particularly no description for limiting the invention in the following description. In the following description, an ink jet printer 1 (hereinafter referred to as a printer) in an ink jet recording head (hereinafter referred to as a recording head) which is one kind of a liquid ejecting head is mentioned as an example of the liquid ejecting apparatus of the invention.

The configuration of the printer 1 is described with reference to FIGS. 1A and 1B. The printer 1 is a device of ejecting a liquid ink onto the surface of a recording medium 2 (one kind a landing target, which is also referred to as a target recording medium), and then recording an image and the like. The printer 1 has a recording head 3, a carriage 4 to which the recording head 3 is attached, a guide rod 5 of pivotally supporting the carriage 4, a transporting mechanism 6 of transporting the recording medium 2 in the subscanning direction (direction indicated by the arrow of FIG. 1A), and the like. The recording medium 2 of this embodiment is held in a state where the recording medium 2 is wound around a core 8 in the shape of a roll. Then, the recording medium 2 moves on each platen 9 disposed with a space from the undersurface (nozzle surface) of the recording head 3 by the drive of the transporting mechanism 6. A configuration in which a plurality of recording media are stored in a paper feed tray provided under the platen, and then the recording media are transported one by one by the transporting mechanism can also be adopted.

The guide rod 5 is installed in the printer 1 along the direction orthogonal to the subscanning direction. The carriage 4 moves back and forth in the main scanning direction (width direction of the recording medium 2) by a pulse motor (not illustrated), such as DC motor, while being guided by the guide rod 5. The transporting mechanism 6 has a paper feed roller 12 on the upstream side and a transporting roller 13 disposed on the downstream side. The paper feed roller 12 is constituted by a pair of upper and lower rollers 12*a* and 12*b* which can be synchronously rotated in the opposite directions in a state where the recording medium 2 is pinched. The paper feed roller 12 is driven by the power from a paper feed motor (not illustrated) to feed the recording medium 2 to the recording head 3 side. The transporting roller 13 is disposed between an intermediate platen 16 and a downstream platen 17, which are described later, and moves (transports) the recording medium 2 on which a resin ink lands to the downstream platen 17 side.

Figure 1B:
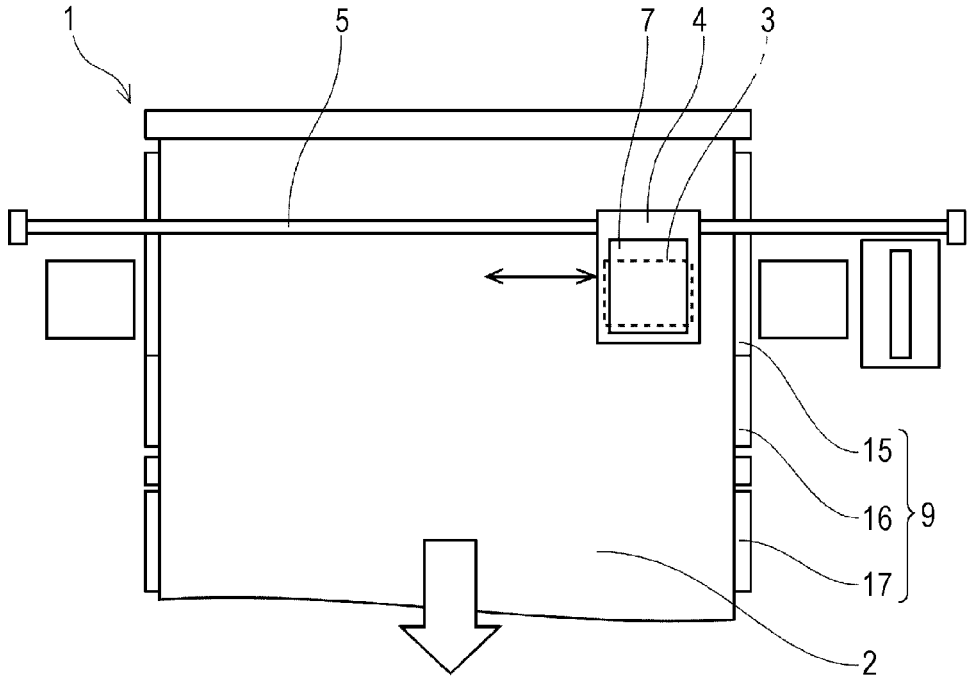
FIG. 1B is a schematic view for explaining the configuration of a printer and is a plan view.

The platen 9 of this embodiment is configured in such a manner as to be divided into three regions as illustrated in FIG. 1A. Specifically, the platen 9 has an upstream platen 15 disposed at a position where the upstream platen 15 face the recording head 3, the intermediate platen 16 disposed on the downstream side in the transfer direction (subscanning direction) of the recording medium 2 relative to the upstream platen 15, and the downstream platen 17 disposed on the downstream side in the transfer direction of the recording medium 2 relative to the intermediate platen 16. More specifically, ink droplets are ejected from the recording head 3 to the recording medium 2 on the upstream platen 15, and then the recording medium 2 is successively transported to the intermediate platen 16, and then the downstream platen 17. The upstream platen 15, the intermediate platen 16, and the downstream platen 17 each are provided with a heater which is not illustrated. The platens 15, 16, and 17 are heated by heat generation from these heaters, whereby the recording medium 2 to be transported can be heated. Each heater is connected to a control portion which is not illustrated. The upstream platen 15, the intermediate platen 16, and the downstream platen 17 each are set to a predetermined temperature by a signal from the control portion.

In this embodiment, the upstream platen 15 is set to the temporary curing temperature of the ink to be ejected from the recording head 3, and heats the ink landing on the recording medium 2 to the temporary curing temperature. The intermediate platen 16 is set to the filming control temperature according to the minimum film forming temperature of the ink to be ejected from the recording head 3, and heats the ink landing on the recording medium 2 to the filming control temperature. Although the details are described later, the filming control temperature is determined according to a desired filming degree of the surface of the ink droplets. The downstream platen 17 is set to the main curing temperature of the ink to be ejected from the recording head 3, and heats the ink landing on the recording medium 2 to the main curing temperature. More specifically, the upstream platen 15 functions as the temporary curing heater in the invention, the intermediate platen 16 functions as the leveling heater in the invention, and the downstream platen 17 functions as the main curing heater in the invention. The platen 9 containing the upstream platen 15, the intermediate platen 16, and the downstream platen 17 is equivalent to the heating unit in the invention. The temporary curing temperature, the filming control temperature, and the main curing temperature are described in detail later.

As the recording medium 2 of this embodiment, a non-ink-absorbing recording medium 2 which does not absorb ink from the surface (surface on which ink lands) or a low-ink-absorbing recording medium 2 which is hard to absorb ink is used. For example, those in which plastic coating is performed or a plastic film is bonded to base materials, such as a plastic film and paper which are not surface-treated, and the like are mentioned. The plastic used herein includes polyvinyl chloride, polyethylene terephthalate, polycarbonate, polystyrene, polyurethane, polyethylene, polypropylene, and the like.

As the ink of this embodiment, an ink containing thermoplastic resin particles is used so that an image and the like can be recorded on such a non-ink-absorbing or low-ink-absorbing recording medium 2. The ink is described in detail later. The ink is stored in an ink cartridge 7 as a liquid supply source. Then, the ink cartridge 7 is detachably attached to the carriage 4 (recording head 3). A configuration in which the ink cartridge 7 is disposed on the side of the main body of the printer 1, and the ink is supplied to the recording head 3 through an ink supply tube from the ink cartridge 7 can also be adopted.

The ink of this embodiment is an ink containing thermoplastic resin particles (hereinafter also referred to as a resin ink) and has a viscosity at 50° C. of 2.1 mPa·s or more. Then, when the resin ink is dried, the resin ink forms a firm resin film in such a manner as to cover a colorant on the medium. Therefore, when printing an image on a non-ink-absorbing medium, abrasion resistance can be imparted to an image by the use of the resin ink. Examples of such an ink are described below.

The ink for use in this embodiment does not substantially contain glycerin having a boiling point under one atmospheric pressure of 290° C. When the ink substantially contains glycerin, the drying properties of the ink sharply decrease. As a result, the density unevenness of an image is noticeable and also the fixability of the ink is not obtained on various target recording media, particularly a non-ink-absorbing or low-ink-absorbing target recording medium. Furthermore, it is preferable not to substantially contain alkyl polyols having a boiling point under a pressure equivalent to one atmospheric pressure of 280° C. or higher (except the glycerin mentioned above).

The ink of this embodiment may also contain a coloring material. The coloring material is selected from pigments and dyes.

In this embodiment, the lightfastness of the ink can be increased by using pigments as the coloring material. As the pigments, both inorganic pigments and organic pigments can be used.

The inorganic pigments are not particularly limited and, for example, include carbon black, iron oxide, titanium oxide, and silica oxide.

The organic pigments are not particularly limited and, for example, include quinacridone pigments, quinacridone-quinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perinone pigments, quinophthalone pigments, anthraquinone pigments, thioindigo pigments, benzimidazolone pigments, isoindolinone pigments, azomethine pigments, and azo pigments.

In this embodiment, dyes can be used as the coloring material. The dyes are not particularly limited and acid dyes, direct dyes, reactive dyes, and basic dyes can be used.

The content of the coloring material is preferably 0.4% by mass or more and 12% by mass or less and more preferably 2% by mass or more and 5% by mass or less based on the total mass (100% by mass) of the ink.

The ink in this embodiment contains resin. Due to the fact that the ink contains resin, a resin coating is formed on a target recording medium, and, as a result, an effect of sufficiently fixing the ink onto the target recording medium, and mainly improving the abrasion resistance of the image is demonstrated. Therefore, a resin emulsion is preferably a thermoplastic resin.

The thermal deformation temperature of the resin is preferably 40° C. or higher because advantageous effects that it is difficult to cause clogging of a head and abrasion resistance is imparted to recorded matter are obtained. The temperature is more preferably 60° C. or higher.

Specific examples of the thermoplastic resin include, but not particularly limited thereto, (meth)acryl polymers, such as poly(meth)acrylic acid ester or a copolymer thereof, polyacrylonitrile or a copolymer thereof, polycyanoacrylate, polyacrylamide, and poly(meth)acrylic acid, polyolefin polymers, such as polyethylene, polypropylene, polybutene, polyisobutylene, polystyrene, copolymers thereof, petroleum resin, coumarone-indene resin, and terpene resin, vinyl acetate or vinyl alcohol polymers, such as polyvinyl acetate or a copolymer thereof, polyvinyl alcohol, polyvinyl acetal, and polyvinyl ether, halogen containing polymers, such as polyvinyl chloride or a copolymer thereof, polyvinylidene chloride, fluororesin, and fluororubber, nitrogen containing vinyl polymers, such as polyvinyl carbazole, polyvinyl pyrrolidone or a copolymer thereof, polyvinyl pyridine, and polyvinyl imidazole, diene polymers, such as polybutadiene or a copolymer thereof, polychloroprene, and polyisoprene (butyl rubber), other ring opening polymerization resin, condensation polymerization resin, and natural polymer resin.

The content of the resin is preferably 1% by mass to 30% by mass and more preferably 1% by mass to 5% by mass based on the total mass (100% by mass) of the ink. When the content is within the range mentioned above, the glossiness and the abrasion resistance of an image to be formed can be further improved.

The resin which may be compounded in the ink, a resin dispersant, a resin emulsion, wax, and the like are mentioned, for example.

The ink of this embodiment may also contain a resin emulsion. The resin emulsion demonstrates an effect of sufficiently fixing the ink on a target recording medium to improve the abrasion resistance of an image by forming a resin coating with preferably wax (emulsion) when the target recording medium is heated. Due to the above-described effect, the recorded matter on which recording is performed using the ink containing a resin emulsion, excellent abrasion resistance is achieved particularly on a target non ink absorbing or low-ink-absorbing recording medium.

The ink of this embodiment may contain water. In particular, when the ink is a water-based ink, water is a medium serving as the main component of the ink. When the target recording medium is heated in ink jet recording, water serves as an ingredient which evaporates and scatters.

The ink of this embodiment may also contain a known volatile water-soluble organic solvent. However, as described above, it is preferable for the ink of this embodiment not to substantially contain glycerin which is one kind of an organic solvent (boiling point under one atmospheric pressure of 290° C.) and not to substantially contain alkyl polyols having a boiling point under a pressure equivalent to one atmospheric pressure of 280° C. or higher (except the glycerin mentioned above).

The ink of this embodiment may also further contain an antiseptic/antifungal agent, an antirust, a chelation agent, and the like in addition to the ingredients mentioned above.

It is preferable for the ink composition of this embodiment to contain an aprotic polar solvent. Due to the fact that the aprotic polar solvent is contained, the above-described resin particles contained in the ink are dissolved. Therefore, clogging of a nozzle can be effectively prevented in ink jet recording. Moreover, the aprotic polar solvent has a property of dissolving a recording medium of vinyl chloride or the like. Therefore, the adhesiveness of an image improves.

Figure 2:
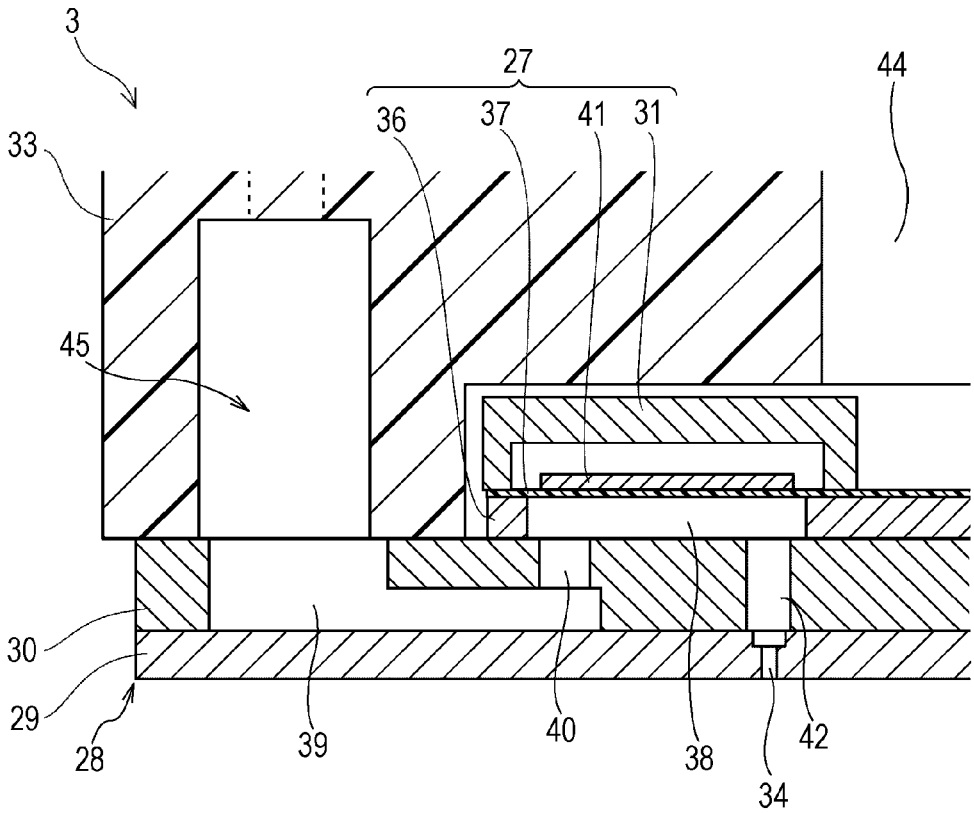
FIG. 2 is a schematic cross sectional view of a recording head.

Next, a recording head 3 is described. FIG. 2 is a schematic cross sectional view of the recording head 3. In FIG. 2, since the configuration of the principle portion corresponding to the other nozzle row is bilaterally symmetrical to one illustrated in FIG. 2 and thus is omitted. As illustrated in FIG. 2, the recording head 3 in this embodiment has a pressure generating unit 27 and a flow path unit 28 and is attached to a case 33 where these members are laminated.

The case 33 is a box-like member containing a synthetic resin constituting a major part of the recording heads 3. As illustrated in FIG. 2, a long penetration space portion 44 is formed in the center portion of this case 33 along the nozzle row direction in a state of penetrating in the height direction of the case 33. In the penetration space portion 44, one end portion of a flexible cable which is not illustrated is accommodated. Moreover, an ink introduction path 45 is formed in the case 33. In the ink introduction path 45, the upper end thereof is connected to the flow path on the upstream side and the lower end is connected to a common liquid chamber 39 (reservoir) of the flow path unit 28. Thus, the ink from the ink cartridge 7 is introduced into the common liquid chamber 39 through the ink introduction path 45.

The flow path unit 28 has a nozzle plate 29 (one kind of a nozzle formation member) in which a plurality of nozzles 34 are provided in the shape of a straight row (the shape of a row) and a communication substrate 30 provided with the common liquid chamber 39. The plurality of nozzles 34 provided in the shape of a row are provided at an equal interval in the pitch corresponding to the dot formation density from the nozzle 34 on one end side to the nozzle 34 on the other end. In this embodiment, the nozzle row (one kind of a nozzle group) is constituted by disposing 360 nozzles 34 in the shape of a row in the pitch corresponding to 360 dpi. In this embodiment, two nozzle rows are formed in the nozzle plate 29. The common liquid chamber 39 is a space portion integrally formed along the nozzle row direction and two rows are formed corresponding to two nozzle rows. On the nozzle 34 side (pressure chamber 38 side) of the common liquid chamber 39, a plurality of liquid introduction ports 40 communicating with the pressure chambers 38 are provided corresponding to each of the pressure chambers 38.

In a pressure generating unit 27, a pressure chamber formation substrate 36 (one kind of a pressure chamber formation member) in which the pressure chambers 38 are formed, an elastic film 37, a piezoelectric element 41, and a protective substrate 31 are laminated and unitized. Ink is introduced into the pressure chamber 38 through the liquid introduction port 40 from the common liquid chamber 39, and then a drive signal from a control portion is supplied to the piezoelectric element 41 through a flexible cable, whereby the piezoelectric element 41 is driven to cause pressure fluctuation in the pressure chamber 38. By utilizing the pressure fluctuation, ink droplets are ejected from the nozzles 34 through a nozzle communication path 42 penetrating the communication substrate 30.

In the printer 1 of the invention, the above-described resin ink is ejected, and then the recording medium 2 on which the resin ink lands is heated by the platen 9 to thereby fix the ink on the recording medium 2. Specifically, the recording medium 2 is heated to the temporary curing temperature by the upstream platen 15, ink droplets land in the state, the recording medium 2 is heated to the filming control temperature according to the minimum film forming temperature by the intermediate platen 16, and then finally, the recording medium 2 is heated to the main curing temperature by the downstream platen 17. Herein, the minimum film forming temperature of ink is a temperature at which almost all the moisture or a part of a solvent in an ink composition volatilizes, and then the filming of the ink surface starts (the thermoplastic resin contained in the ink is deformed, and then the thermoplastic resin starts to be bonded to each other). The temporary curing temperature is a temperature at which the moisture in the ink composition evaporates to some extent, and then the ink viscosity starts to rise. At the temporary curing temperature, the volatilization of the solvent is hard to occur and the filming does not occur. The main curing temperature is a temperature at which the moisture and the solvent in the ink composition almost volatilize and ink droplets are completely filmed. The filming control temperature is a temperature set as appropriate according to the minimum film forming temperature in order to control the filming degree of the surface of the ink droplets. For example, when the filming of the surface of the ink droplets is desired to be retarded, the filming control temperature is set to be equal to or lower than the minimum film forming temperature. On the contrary, when the filming of the surface of the ink droplets is desired to be accelerated, the filming control temperature is set to a temperature higher than the minimum film forming temperature and equal to or lower than the main curing temperature. When the filming of the surface of the ink droplets is retarded, the ink droplets whose volume has decreased by the volatilization of the moisture and the solvent become flat on the recording medium 2. On the other hand, when the filming of the surface of the ink droplets is accelerated, the surface of the ink droplets is filmed before the moisture and the solvent of the ink droplets volatilize, and the shape of the ink droplets is maintained to some extent on the recording medium 2. More specifically, the size of the irregularities formed by the ink droplets can be controlled by controlling the filming control temperature.

Figure 3A:
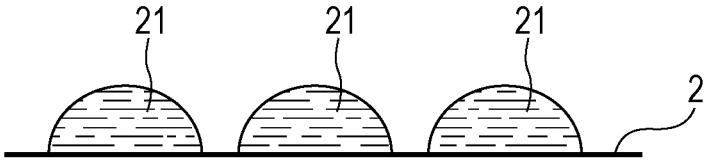
FIGS. 3A to 3C are schematic views for explaining the state of ink droplets landing on a recording medium.
Figure 3B:
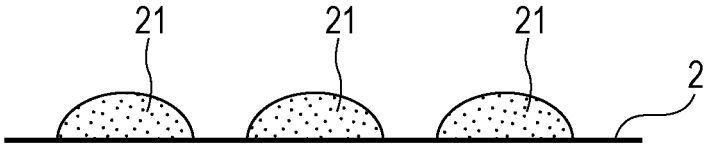
Figure 3C:
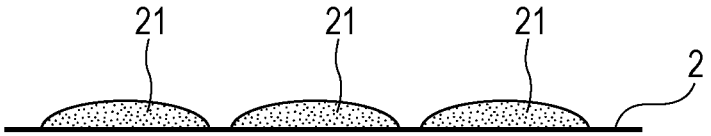

Next, a filming process of the ink droplets is described. FIGS. 3A to 3C are schematic views for explaining the state of the ink droplets 21 landing on the recording medium 2. Hereinafter, a case where a resin ink whose minimum film forming temperature is about 70° C. is used, for example, is described.

First, each of the platens 15, 16, and 17 is heated to each preset temperature. In this state, the recording medium 2 is transported onto the upstream platen 15 by a transporting mechanism 6. Then, ink droplets are ejected from the nozzles 34 of the recording head 3, and then an image according to print data is formed on the recording medium 2 while transporting the recording medium 2. Each ink droplet 21 landing on the recording medium 2 forms a hemispherical dot as illustrated in FIG. 3A. The height of the dot (height of the ink droplet 21) changes according to the contact angle of the recording medium 2 and the ink even in the case of the same volume. The ink droplets 21 landing on the recording medium 2 are warmed to the temporary curing temperature (for example, 40° C. to 60° C.) by the upstream platen 15. Herein, since the recording medium 2 is set to move on the upstream platen 15 over 120 to 240 seconds, the recording medium 2 is warmed to the temporary curing temperature corresponding to the time. Thus, in the ink droplets 21 which are warmed to the temporary curing temperature, the moisture in the composition evaporates to some extent, so that the viscosity rises. As a result, the ink droplets 21 can be prevented from shifting from the landing position on the recording medium 2, and a high definition image with less density unevenness can be formed.

The recording medium 2 which is warmed to the temporary curing temperature by the upstream platen 15 is transported to the intermediate platen 16 by the transporting mechanism 6. Then, the ink droplets 21 on the recording medium 2 are warmed at the filming control temperature. Herein, the filming control temperature is determined according to a desired filming degree of the surface of the ink droplets 21 as described above. For example, when a mat feeling is desired to be imparted to the image formed on the recording medium 2 or a gloss feeling is desired to be suppressed, the filming control temperature is set to a temperature higher than the minimum film forming temperature and equal to or lower than the main curing temperature (for example, 80° C. to 90° C.). Thus, the surface of the ink droplets 21 is filmed and also the moisture and the solvent of the ink droplets 21 volatilize, and the volume of the ink droplets 21 decreases while almost maintaining the shape as illustrated in FIG. 3B. On the other hand, a gloss feeling is desired to be imparted to the image formed on the recording medium 2, the filming control temperature is set to be equal to or lower than the minimum film forming temperature (for example, 60° C. to 70° C.). Thus, the moisture and the solvent of the ink droplets 21 volatilize and the volume of the ink droplets 21 on the recording medium 2 decreases but the surface of the ink droplets 21 is not filmed or the filming is retarded, so that the ink droplets 21 spread in the plane of the recording medium 2 as illustrated in FIG. 3C. As a result, the height of irregularities formed by the ink droplets 21 becomes smaller than the height when the filming control temperature is set to be equal to or lower than the main curing temperature. The time taken for warming the ink droplets 21 on the recording medium 2 at the filming control temperature by the intermediate platen 16 is preferably 40 seconds or more and 80 seconds or less. Thus, the moisture and the solvent of the ink droplets 21 can be sufficiently volatilized, and the printing time can be prevented from being prolonged. The filming control temperature is set beforehand according to a desired image quality (degree of gloss).

The recording medium 2 warmed to the minimum film forming temperature by the intermediate platen 16 is transported to the downstream platen 17 by the transporting mechanism 6 (transporting roller 13). Then, the ink droplets 21 on the recording medium 2 are warmed for several seconds to tens of seconds at the main curing temperature (for example, 90° C. to 100° C.), the moisture and the solvent almost volatilize, and then the ink droplets 21 are completely filmed. Thus, the ink droplets 21 can be certainly fixed on the recording medium 2.

Thus, since the platen 9 controls the filming degree of the surface of the ink droplets by heating the ink droplets at the filming control temperature according to the minimum film forming temperature at which the filming of the surface of the ink droplets starts, the degree of the irregularities formed by the ink droplets can be controlled. Thus, a gloss feeling of the image to be formed can be controlled. For example, a gloss feeling is imparted to impart a high-class feeling to the image to be formed or a mat feeling is imparted to suppress reflection of the surrounding light. Specifically, the irregularities formed by the ink droplets can be made small by setting the filming control temperature to be equal to or lower than the minimum film forming temperature. Thus, the glossiness of the image to be formed can be increased, and a gloss feeling can be further imparted. Moreover, the irregularities formed by the ink droplets can be enlarged by setting the filming control temperature to be a temperature higher than the low film forming temperature and equal to or lower than the main curing temperature. Thus, the glossiness of the image to be formed can be reduced, so that a mat feeling can be imparted. Since the platen 9 has the upstream platen 15 of heating the recording medium 2 at the temporary curing temperature, the intermediate platen 16 of heating the recording medium 2, which is heated by the upstream platen 15, at the filming control temperature, and the downstream platen 17 of heating the recording medium 2, which is heated by the intermediate platen 16, at the main curing temperature, the filming degree of the surface of the ink droplets can be controlled only by transporting the recording medium 2 from the upstream platen 15 to the downstream side platen through the intermediate platen 16.

Figure 4:
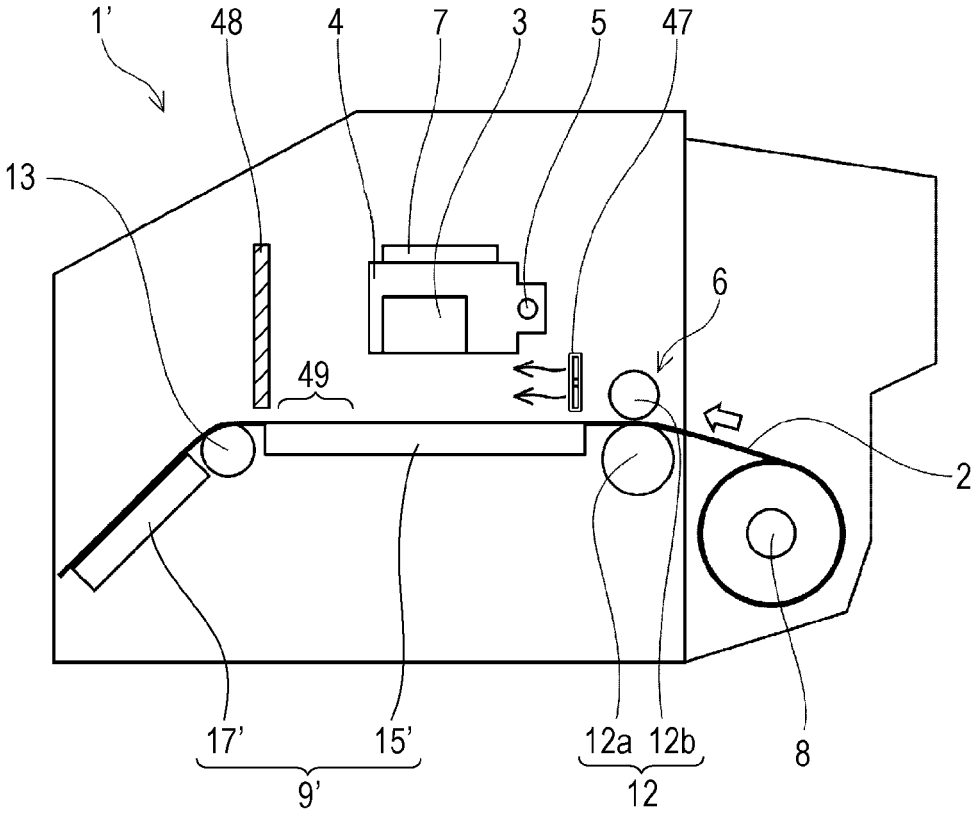
FIG. 4 is a schematic view for explaining the configuration of a printer according to a second embodiment.

In the above-described embodiment, the intermediate platen 16 is provided and the recording medium 2 is heated to the filming control temperature by the intermediate platen 16 but the invention is not limited thereto. In a printer 1' of another embodiment illustrated in FIG. 4, the intermediate platen is not provided and an upstream platen 15' is made to extend to the position of the intermediate platen of the embodiment described above.

Specifically, in the printer 1' of this embodiment, the upstream platen 15' of heating the recording medium 2 at the temporary curing temperature is disposed between the paper feed roller 12 and the transporting roller 13, and a downstream platen 17' of heating the recording medium 2 at the main curing temperature is disposed on the downstream side of upstream platen 15' with the transporting roller 13 interposed therebetween. More specifically, a platen 9' of this embodiment is constituted by the upstream platen 15' and the downstream platen 17'. Moreover, a fan 47 (equivalent to the air sending unit in the invention) which sends the heat of the upstream platen 15' to the recording medium 2 on the downstream side is provided above the upstream platen 15' and at one end portion on the upstream side (paper feed roller 12 side) of the upstream platen 15'. By the fan 47, the air heated by the heat generation of the upstream platen 15' can be sent to the downstream side. Furthermore, a shielding plate 48 of shielding the air flow is formed above the upstream platen 15' and at one end portion on the downstream side (transporting roller 13 side) of the upstream platen 15'. The shielding plate 48 can suppress the hot wind sent from the fan 47 from passing to the outside (downstream platen 17' side) and can make heat stay in the space between the shielding plate 48 and the recording head 3. Thus, the temperature of a filming control region 49 (region between the shielding plate 48 and the recording head 3) on the downstream side of the upstream platen 15' can be set to a temperature higher than that of the upstream platen 15' and the recording medium 2 transported to the filming control region 49 can be warmed to the filming control temperature higher than the temporary curing temperature. Then, the recording medium 2 heated to the filming control temperature by the fan 47 is transported to the downstream platen 17' by the transporting roller 13, and is heated to the main curing temperature by the downstream platen 17'.

In the filming control region 49, the filming control temperature can be controlled by the air sending amount of the fan 47, i.e., the number of rotations of the fan 47. Moreover, in this embodiment, the platen 9' constituted by the upstream platen 15' and the downstream platen 17' and the fan 47 are equivalent to the heating unit in the invention. Since other configurations are the same as those of the embodiment described above, the duplicated description is omitted.

Moreover, although the heater is provided in each of the platens 15, 16, and 17 and is made to function as a heating unit in the embodiment described above, but the invention is not limited thereto and a heating unit can also be separately provided from the platen. For example, it can be configured so that a heater is provided at an interval from the recording head above the recording head (opposite to the nozzle surface (nozzle plate), and the heat of the heater is sent to the recording medium by an air sending unit which is separately provided. In brief, it may be configured so that a region where the recording medium is heated at the filming control temperature according to the minimum film forming temperature is provided between the region where the recording medium is heated at the temporary curing temperature and the region where the recording medium is heated at the main curing temperature.

Furthermore, in the description above, a so-called bending vibration piezoelectric element 41 is mentioned as an example of a pressure generating unit but the invention is not limited thereto and, for example, a so-called vertical vibration piezoelectric element can also be adopted. In addition thereto, the invention can also be applied to a configuration in which a pressure generating unit, such as a heat generating element which causes pressure fluctuation by generating air bubbles in ink by heat generation or an electrostatic actuator which causes pressure fluctuation by displacing a partition wall of a pressure chamber by electrostatic force is adopted as the pressure generating unit.

What is claimed is:

1. A liquid ejecting apparatus, comprising:

a liquid ejecting head capable of ejecting an ink containing thermoplastic resin particles from nozzles to a landing target; and a heating unit of heating ink droplets landing on the landing target, the heating unit heating the ink droplets at a filming control temperature according to a minimum film forming temperature at which filming of a surface of the ink droplets starts to thereby control a filming degree of the surface of the ink droplets.

2. The liquid ejecting apparatus according to claim 1, wherein the heating unit performs heating at a temporary curing temperature of increasing a viscosity without filming the ink droplets, and then performs heating at the filming control temperature.

3. The liquid ejecting apparatus according to claim 2, wherein the heating unit performs heating at the filming control temperature, and then performs heating at a main curing temperature at which all the ink droplets are filmed.

4. The liquid ejecting apparatus according to claim 3, wherein the heating unit has a temporary curing heater of heating the landing target at the temporary curing temperature, a leveling heater of heating the landing target, which is heated by the temporary curing heater, at the filming control temperature, and a main curing heater of heating the landing target, which is heated by the leveling heater, at the main curing temperature.

5. The liquid ejecting apparatus according to claim 3, wherein the heating unit has a temporary curing heater of heating the landing target at the temporary curing temperature, an air sending unit capable of sending heat of the temporary curing heater to the landing target side to heat the landing target to the filming control temperature, and a main curing heater of heating the landing target, which is heated to the filming control temperature by the air sending unit, at the main curing temperature.

6. The liquid ejecting apparatus according to claim 1, wherein the filming control temperature is equal to or lower than the minimum film forming temperature.

7. The liquid ejecting apparatus according to claim 6, wherein the filming control temperature is applied for 40 seconds or more and 80 seconds or less.

8. The liquid ejecting apparatus according to claim 1, wherein the filming control temperature is a temperature higher than the minimum film forming temperature and equal to or less than the main curing temperature at which all the ink droplets are filmed.

9. The liquid ejecting apparatus according to claim 8, wherein the filming control temperature is applied for 40 seconds or more and 80 seconds or less.

* * * * *